US006832868B2

(12) United States Patent
Hertwig et al.

(10) Patent No.: US 6,832,868 B2
(45) Date of Patent: Dec. 21, 2004

(54) WRITING IMPLEMENT WHICH LENGTHENS AND SHORTENS WHEN ACTUATED

(75) Inventors: Andre Hertwig, Edingen (DE); Wolfgang Nestlen, Dossenheim (DE)

(73) Assignee: C. Josef Lamy GmbH, Heidelberg (DE)

( * ) Notice: Subject to any disclaimer, the term of this patent is extended or adjusted under 35 U.S.C. 154(b) by 15 days.

(21) Appl. No.: 10/455,791

(22) Filed: Jun. 6, 2003

(65) Prior Publication Data

US 2004/0042839 A1 Mar. 4, 2004

Related U.S. Application Data

(63) Continuation of application No. PCT/EP01/10963, filed on Sep. 22, 2001.

(30) Foreign Application Priority Data

Dec. 8, 2000 (DE) ..... 100 61 316

(51) Int. Cl.[7] ..... B43K 7/12
(52) U.S. Cl. ..... 401/117; 401/112; 401/99
(58) Field of Search ..... 401/99, 109–112, 401/117

(56) References Cited

U.S. PATENT DOCUMENTS 2,627,843 A 2/1953 Frentzel
3,302,619 A 2/1967 Schoodterer
4,601,599 A * 7/1986 Katoh ..... 401/99
6,273,627 B1 * 8/2001 Mittersinker et al. ..... 401/117
6,474,889 B2 * 11/2002 Kato ..... 401/117
6,752,557 B1 * 6/2004 Hsieh ..... 401/117

FOREIGN PATENT DOCUMENTS

EP 402 558 A 12/1990
EP 968 843 A 1/2000

* cited by examiner

*Primary Examiner*—Gregory L. Huson
*Assistant Examiner*—Huyen Le
(74) *Attorney, Agent, or Firm*—Crowell & Moring LLP

(57) ABSTRACT

A writing implement comprising a housing (2), a writing cartridge (4) arranged in the housing in a movable manner, and a control unit that displaces the writing cartridge between a first position in which the cartridge tip (6) protrudes from the housing for writing, and a second position in which the cartridge is retracted into the housing. In the first position the writing implement has a total length suitable for writing, and in the second position the writing implement is contracted. The writing implement exhibits improved handling without major structural modification, so that the writing implement can be brought into the writing position and also extended in a single hand movement. To achieve this the implement is provided with a depressor (8) which is configured as an extension of the housing and can be actuated to move the writing cartridge between the first and second positions, and which in the first position extends out from the rear end of the housing.

14 Claims, 6 Drawing Sheets

WRITING IMPLEMENT WHICH LENGTHENS AND SHORTENS WHEN ACTUATED

CROSS REFERENCE TO RELATED APPLICATIONS

This application is a continuation of international patent application no. PCT/EP01/10963, filed Sep. 22, 2001, designating the United States of America, and published in German as WO 02/45974, the entire disclosure of which is incorporated herein by reference. Priority is claimed based on Federal Republic of Germany patent application no. DE 100 61 316.0, filed Dec. 8, 2000.

BACKGROUND OF THE INVENTION

The invention relates to a writing implement comprising a housing, a writing cartridge movably arranged in the housing, and a control unit form moving the writing cartridge between a first position in which the cartridge tip is extended out of the housing for writing, and a second position in which the writing cartridge is retracted within the housing, wherein in the first position the writing implement has an overall length suitable for writing and in the second position the writing implement is shortened.

A writing implement of this general type is disclosed in EP 402,558A. This writing implement comprises a housing, a depressor configured as an extension of the housing, and a control unit with a first switching cam by which the writing cartridge can be extended into its first writing position or moved into the housing in its second retracted position. The control unit further comprises a second switching cam that interacts with the depressor. To push the writing cartridge out of the housing into the writing position, the depressor must be pulled backward out of the housing. This "pulling motion" to displace the writing cartridge forward into its writing position makes handling more difficult, especially since this motion is in inverse direction of the desired forward motion of the writing cartridge out of the housing toward the front. In the writing position, the writing cartridge is secured against being pushed back into the housing by a pin that engages a rearward pointing part of the first cam. To shorten the writing implement and move the writing cartridge into the second retracted position, the depressor is pushed in the direction of the housing, i.e., against the aforementioned "pulling motion." In its telescoped, short position, the depressor is not fixed relative to the housing, so that when the writing implement is taken out of a holder, for example, the depressor could be accidentally pulled backward and the writing cartridge pushed forward out of the housing. The writing implement is difficult to handle in that to set the writing position, a user must hold the housing with one hand to be able to pull the depressor backward out of the housing with the other hand.

EP 968,843A furthermore discloses a variable writing implement whose rear housing part including a depressor is coupled to the front housing part via a gear-type connection with racks and an engaging pinion. To extend the shortened writing implement and push out the writing cartridge, the depressor together with the rear housing part must be pulled out of the front housing part.

Furthermore, U.S. Pat. No. 2,627,843 discloses a writing instrument whose housing is made of two parts that can be telescoped into one another. Disposed in the front part is a writing cartridge, which can be axially displaced by a control unit in such a way that in a first position, the tip of the cartridge protrudes from the front part for writing and in a second position, the tip of the cartridge is retracted into the front part. The control unit includes an axially displaceable and partially rotatable first sleeve in which the writing cartridge is inserted and from which the writing cartridge can be removed when required after removal of a housing tip. A pin of the front part engages a short spiral groove in the outer surface of the rotatable control sleeve, so that the first sleeve is axially displaced as it is rotated and the writing cartridge is thereby displaced into the first or the second position. The interior of the rear part of the housing contains an additional sleeve with an axial slot in which a projection provided on the rear end of the front part engages. This additional sleeve of the rear part further has an axially inwardly pointing projection that engages a second long spiral groove of the control sleeve of the front part. When the front part and the rear part are telescoped, the first sleeve is rotated by the projection of the additional sleeve, which is non-rotatably arranged in the rear part and engages the long spiral groove. In cooperation with the short front spiral groove, the first sleeve is pushed axially rearward and the tip of the cartridge is thus retracted into the housing, its second position. In this second position, the two housing parts are telescoped into one another so that the total length of the housing is shorter overall. To bring the writing cartridge or the writing point into its first or writing position, the front part of the housing and the rear part of the housing are axially pulled apart. The above-described functions then proceed in the reverse direction and the first sleeve, including the writing cartridge, is axially displaced forward and the tip of the cartridge is pushed out of the housing into the first or writing position. After the two housing parts have been fully pulled apart, the writing instrument has its maximum length. The writing instrument is difficult to handle in that both hands are required to pull it apart to adjust the writing position and to telescope the two housing parts in an opposite movement to adjust the second position. Furthermore, there is no mutual locking device of the two housing parts either in the writing position or in the second position. If the two housing parts are accidentally moved relative to one another, proper writing can be affected or the tip of the cartridge can be moved out of its second position, with the risk that articles of clothing or the like may be stained by the writing agent.

SUMMARY OF THE INVENTION

It is therefore an object of the present invention to provide an improved writing implement of the aforedescribed type.

Another object of the invention is to provide a writing implement without major structural modification which will exhibit improved handling.

A further object of the invention is to provide a writing implement in which the writing cartridge can be extended into its functional or writing position and the writing implement itself simultaneously lengthened with a single manual action.

An additional object is to provide a writing implement which is operable with one hand and is extendable into the size that is suitable for writing with the same type of movement that is required to shorten it and to retract the writing cartridge into its standby position.

Yet another object of the invention is to provide a writing implement in which the two positions of the writing cartridge are reliably defined and any accidental actuation is reliably avoided.

These and other objects are achieved in accordance with the present invention by providing a writing implement comprising a housing, a writing cartridge movably arranged in said housing, a depressor configured as an extension of the housing, and a control unit having a first switching cam for displacing the writing cartridge between a first position in which the cartridge tip is extended out of the housing for writing, and a second position in which the writing cartridge is retracted within the housing, wherein the writing implement in the first position has an overall length suitable for writing and in the second position is shortened; wherein the control unit has a second switching cam which interacts with the depressor; wherein the depressor can be actuated in the same pressing direction to displace the writing cartridge both into the first position and into the second position, wherein the second switching cam is configured to fix the depressor in the second, telescoped and shorted position, and wherein the second switching cam is configured in such a way that, starting from the telescoped position, the depressor is unlocked when the depressor is actuated in the pressing direction and can be extended out of a rear end of the housing into the first position.

The writing implement according to the invention is distinguished by its functionally reliable design and its simple handling. The two positions are actuated and defined exclusively by a pressing motion. The writing implement has a control unit that is actuated by means of a depressor so that the writing cartridge can be optionally brought into its writing position or into its retracted position. Synchronously with the corresponding actuation, the writing implement is lengthened to the size adapted for writing or shortened for stowing or storing. This creates a small writing implement that is suitable for stowing and storing in small containers, pockets, particularly trouser pockets, notepads, small pocket calendars, small planners or the like.

The control unit comprises a cam element with two preferably inline switching cams. These cams are arranged in such a way that the writing cartridge can be brought into the writing position or the retracted position by means of the first switching cam while the depressor, which is configured as an extension, is displaced out of the housing or retracted into the short position by means of the second switching cam. The first switching cam for the writing cartridge is preferably configured in such a way, and especially as a heart-shaped cam, to ensure that the writing cartridge is reliably blocked in the two possible positions. The switching cam for the depressor is preferably configured as an unlocking control cam.

The depressor, starting from the locked position when the writing implement is shortened, is extended into its lengthened position after unlocking, particularly under the action of a spring force. Advantageously, the cam element is rotatable and axially displaceable inside the housing and, depending on its position, can either prevent the depressor from being extended or can release and unlock it.

Further advantageous aspects and preferred features and embodiments of the invention are described in additional detail in the following.

BRIEF DESCRIPTION OF THE DRAWINGS

The invention will now be described in further detail with reference to illustrative preferred embodiments shown in the accompanying drawings in which.

DETAILED DESCRIPTION OF PREFERRED EMBODIMENTS

Figure 1:
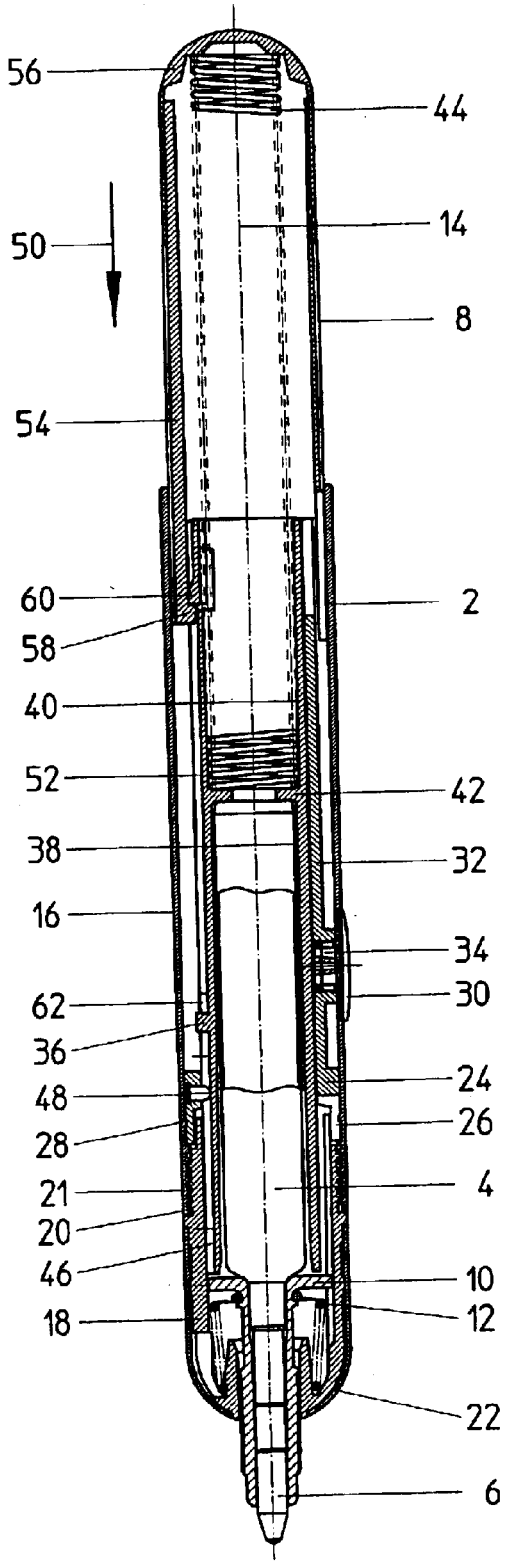
FIG. 1 is an axial sectional view of a writing implement according to the invention in its writing position.

FIG. 1 shows an axial section of a writing implement with a housing 2. A writing cartridge 4 assumes the first or writing position in which a tip 6 of the writing cartridge 4 protrudes from the front end of the housing 2 for writing. At the rear end of the housing 2, a depressor 8 is provided, which in this position extends from the rear end of the housing 2 and forms an extension of the housing. This makes it possible to hold the writing implement normally during writing.

Advantageously, the cartridge tip 6 is guided in a telescopic element 10, which in the writing position shown partially protrudes from the front end of the housing 2. By means of a spring 12, configured as a compression spring and referred to as a telescopic spring, the telescopic element 10 and thus the writing cartridge 4 are pushed rearward in the direction of the longitudinal axis 14. Alternatively, the telescopic element can be eliminated, in which case the spring acts directly on the writing cartridge in the known manner.

The housing 2 has an upper part 16 configured as a sleeve, in particular a substantially cylindrical sleeve, preferably made of metal, and at the front end thereof has a threaded sleeve 18 providing a fixed but if necessary detachable connection, particularly by means of mutually engaging threads 20, 21. On the outside, the threaded sleeve 18 is encompassed by a cap 22 that is provided with an opening at its front end.

A switching sleeve 24 is arranged in the interior of the housing 2 or the upper part 16. This switching sleeve 24 has an annular shape and is fixed inside the housing 2 and secured especially in axial direction. An interlocking connection is preferably provided for this purpose, which advantageously has a radially inwardly pointing projection 26 of the upper part 16. This projection 26 is advantageously annular in shape and engages an associated recess 28 of the switching sleeve 24, which recess 28 is advantageously also annular in shape. Alternatively, this connection can have a radially outwardly pointing projection of the switching sleeve, while the housing 2 or the upper part 16 has a corresponding recess.

Furthermore, an element 30 that protrudes over the outer surface of the upper part 16 and advantageously serves as a rolling protection of the writing implement is connected with the housing 2. The switching sleeve 24 has an extension 32 which is directed toward the rear and which has interlocking means 34 to connect with corresponding interlocking means of said element 30. The interlocking means extend through an opening of the upper housing part 16 into the interior. The switching sleeve 24 is thus also secured against rotation by the element 30.

Like a cam element 36, the switching sleeve 24, which is secured in the axial direction and against rotation within the housing 2, is a component of the aforementioned control unit. The cam element 36 is configured as a sleeve and encloses a front cavity 38 and a rear cavity 40, which are separated by a partition 42. The writing cartridge 4—except for the cartridge tip 6—is arranged in the front cavity 38, while at least a portion of a compression spring 44 acting on the depressor 8 is provided in the rear cavity 40. The rear end of the writing cartridge 4, or an end plug disposed thereon, is supported against the front side of the partition 42.

The cam element 36 on its outer surface has a first switching cam 46, which is particularly configured as a heart-shaped cam. The switching sleeve 24 interacts with the switching cam 46 via a coupling element 48. Preferably the coupling element 48 engages the switching or heart-shaped cam 46 and is a radially inwardly pointing pin 48 that is connected with the switching sleeve 24. The cam element 36 is axially displaceable and rotatable inside the housing 2. Axial actuation of the depressor 8—always in the same pressing direction as indicated by arrow 50—causes the writing cartridge 4 to be optionally displaced into the first, writing position or into the second, retracted standby position by means of the control unit in cooperation with the switching sleeve 24 which is fixed in the housing 2 and the cam element 36 which is displaceable.

Alternatively and within the scope of the invention, the depressor can be extended without any spring force by manually pulling the depressor out of the rear end of the housing. In this case, however, the depressor is first actuated to displace the tip of the writing cartridge out of the front end of the housing. A gear-type connection may also be provided, which after actuation of the depressor on the one hand extends the cartridge tip out of the front end and on the other hand extends the depressor out of the rear end of the housing. Preferably, locking elements are furthermore provided by means of which the depressor is secured in its extended position relative to the housing.

The cam element 36 preferably has a second switching cam 52 axially behind the first switching cam 46 to control and position the depressor 8. The depressor 8 comprises a guide sleeve 54 and a push button cap 56 encompassing this guide sleeve at least at the rear end. The guide sleeve 54 and the push button cap 56 are firmly and permanently connected with one another by means of interlocking elements. Alternatively, within the scope of the invention, the depressor 8 may also be configured as a single part.

As shown, the compression spring 44 is disposed within the depressor 8 to displace the depressor 8 into the depicted extended position and to hold it there. The depressor or the guide sleeve 54 comprises a radially inwardly pointing element 58 that is associated with a further radially outwardly pointing stop element 60 in such a way that the depressor is fixed in its extended position at the rear end of the writing implement. The stop element 60 is particularly advantageously configured as a flexible tab at the rear end of the cam element 36. Alternatively, within the scope of the invention, the housing 2 and the depressor 8 can have stop elements that correspond with one another to limit the axial rearward movement of the depressor 8.

Furthermore, the element 58, which preferably is configured as a radially inwardly pointing projection, engages the second switching cam 52 of the cam element 36. This second switching cam 52 is configured as a T-cam and on its front end has at least one groove part 62 extending in circumferential direction. If the depressor 8 is pushed forward into the housing 2 in the direction of the arrow 50, the element 58 reaches the groove part 62, and the depressor 8 is locked in its pushed-in position by a rotation of the cam element 36. The aforementioned extension 32 of the switching sleeve 24 secured against rotation in the housing 2 corresponds with an axial groove made in the inner surface of the depressor 8 so as to secure the depressor 8 against rotation.

Figure 2:
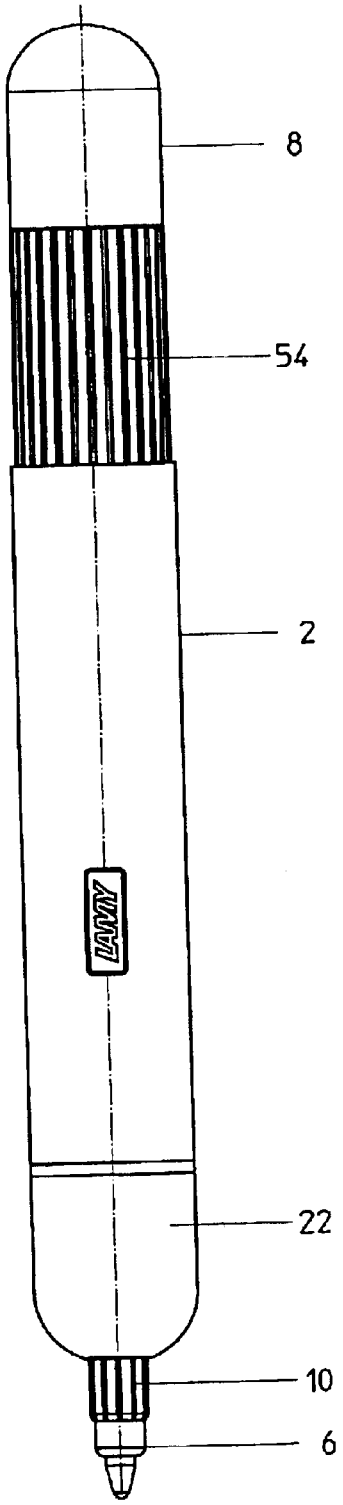
FIG. 2 is a view of the writing implement in accordance with FIG. 1.

FIG. 2 shows a view of the writing implement in its writing position, with the depressor 8 extended from the housing 2 to lengthen the implement. Furthermore the tip 6 and partly also the telescopic element 10 are extended from the front end of the housing 2, or the cap 22 arranged thereon. In this writing position, the writing cartridge is fixed against axial displacement into the housing 2 by means of the above-described control unit and especially the first switching cam, which is configured as a heart-shaped cam, and the associated switching sleeve.

Figure 3:
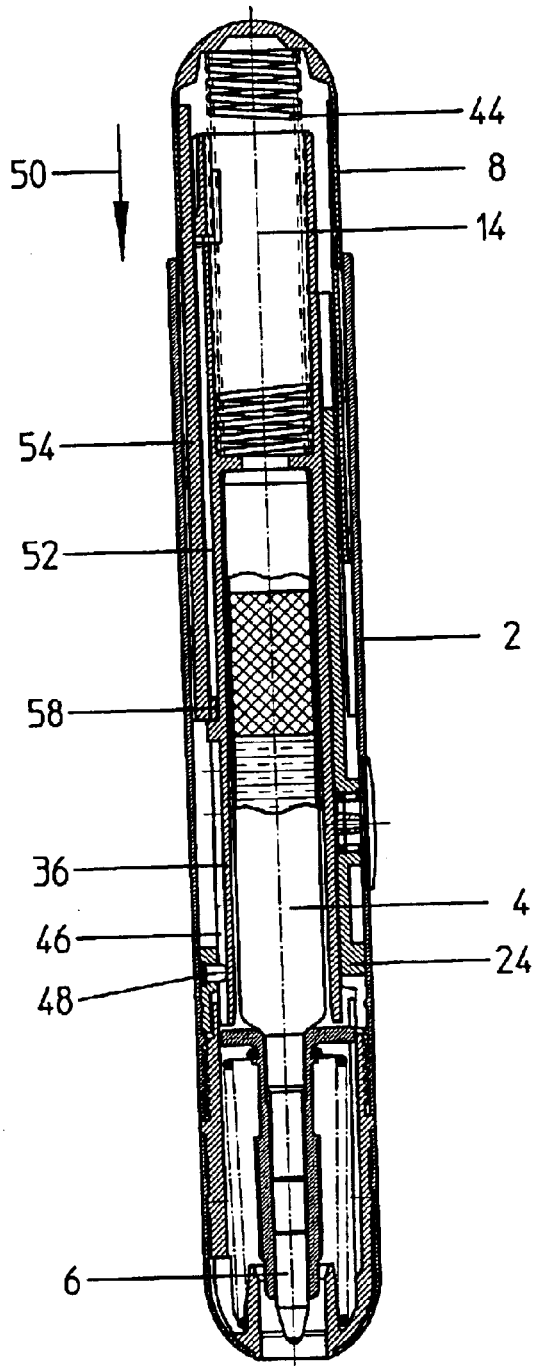
FIG. 3 is an axial section of the writing implement in its telescoped second position.

FIG. 3 shows an axial section of the writing implement in the second position. After a pressing motion has been executed in the direction of the arrow 50, the depressor 8 is now largely pushed into the housing 2. The pressing motion on the depressor 8, which can be executed with one hand, in cooperation with the switching sleeve 24, the coupling element or pin 48 and the first switching cam 46, causes the cam element 36 to be rotated about the longitudinal axis 14 in such a way that the radially inwardly pointing element 58 of the depressor 8 or the guide sleeve 54 engages the above-described circumferentially extending groove part of the second switching cam 52.

Thus, the depressor 8, on which the interior compression spring 44 acts against the direction of the arrow 50, is secured against any accidental extension. Since the depressor 8 is furthermore secured against rotation relative to the housing 2, the depressor 8 and the tip 6 of the writing cartridge 4, which is retracted into the housing 2, reliably remain in the depicted second position.

Figure 4:
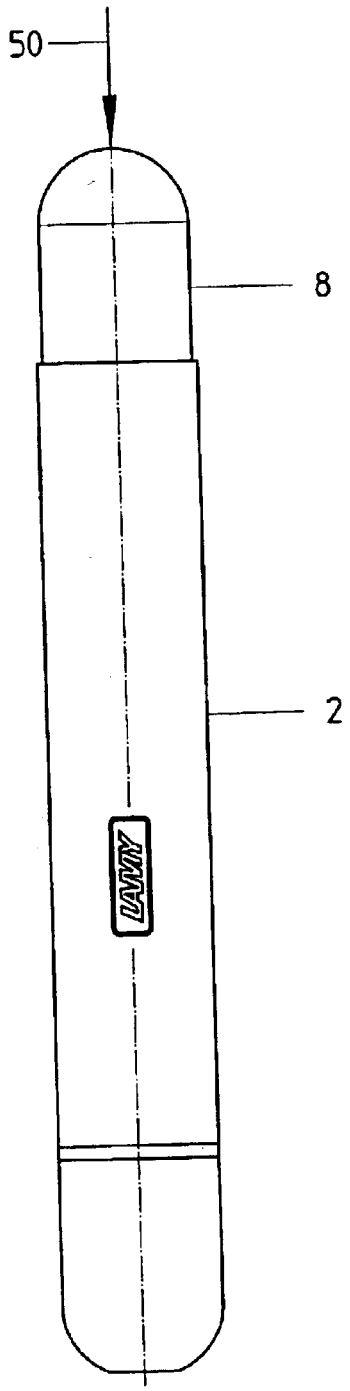
FIG. 4 is a view of the writing implement in accordance with FIG. 3.

In FIG. 4, the writing implement is shown in a side view in its short, telescoped second position. To bring the writing implement back into the writing position described with reference to FIGS. 1 and 2, a user takes the housing 2 into his or her hand in such a way that a pressing motion can be executed on the depressor 8 in the direction of the arrow 50, especially with the thumb. Due to this pressing motion, the depressor 8 is pushed somewhat deeper into the rear end of the housing 2. By means of the control unit and especially the interaction of the switching sleeve with the first switching cam, the cam element is rotated in such a way that the second switching cam releases the depressor 8 for an axial motion against the direction of the arrow 50, and the depressor 8 is extended from the housing 2 by means of the interior compression spring until it assumes the position depicted in FIGS. 1 and 2, so that the writing implement can be securely guided for writing.

Figure 7:
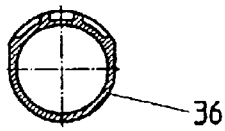
FIGS. 5–7 are sections and a view of the cam element.
Figure 5:
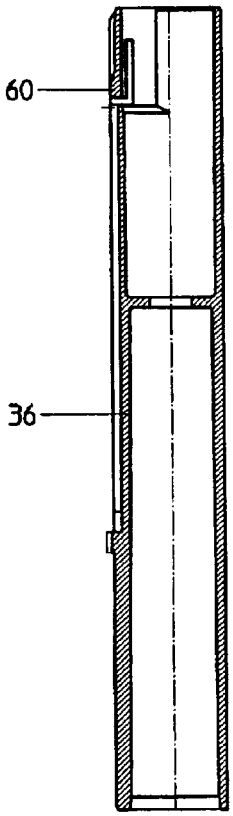
Figure 6:
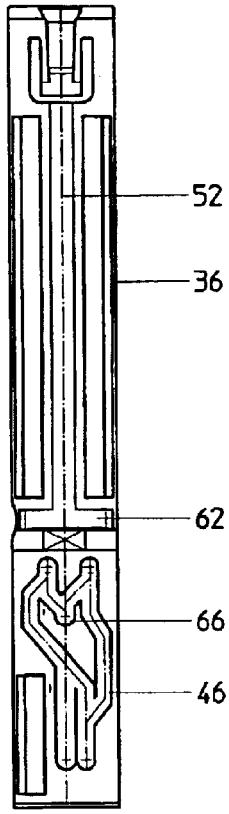

FIGS. 5 to 7 depict sectional views and a side view of the cam element 36. For simplicity of illustration, the first switching cam 46 is not shown in FIG. 5. According to FIG. 6, the first switching cam is configured as a heart-shaped cam and comprises a cam element 66 to fix the writing cartridge in its extended writing position. The second switching cam 52 is preferably configured as a T-cam. At the front end it is provided with the at least one circumferentially extending groove part 62 to hold the depressor in its second retracted position within the housing.

Figure 8:
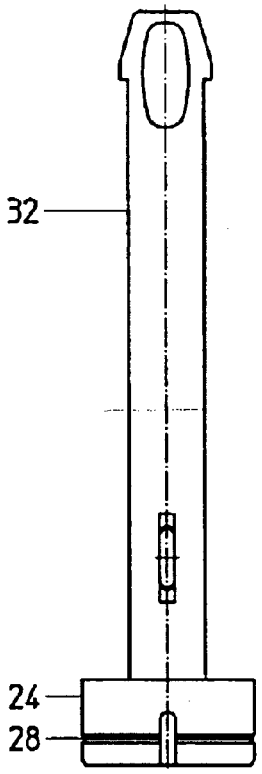
FIGS. 8–10 are views and a section of the switching sleeve.
Figure 9:
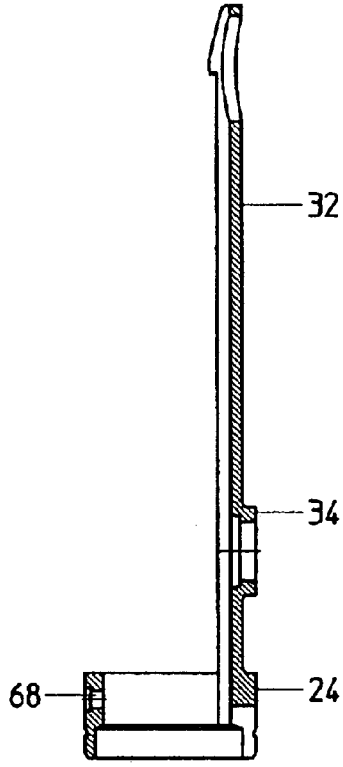
Figure 10:
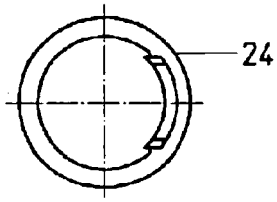

FIGS. 8 to 10 show the switching sleeve 24. In FIG. 9, the interlocking means 34 on the extension 32 is readily visible. The switching sleeve 24 further comprises a substantially radial opening or bore 68 to receive the coupling element or pin 48 that engages with the first switching cam of the cam element.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A writing implement comprising a housing, a writing cartridge movably arranged in said housing, a depressor configured as an extension of the housing, and a control unit having a first switching cam for displacing the writing cartridge between a first position in which the cartridge tip is extended out of the housing for writing, and a second position in which the writing cartridge is retracted within the housing, wherein the writing implement in the first position has an overall length suitable for writing and in the second position is shortened; wherein the control unit has a second switching cam which interacts with the depressor; wherein the depressor can be actuated in the same pressing direction to displace the writing cartridge both into the first position and into the second position, wherein the second switching cam is configured to fix the depressor in the second, telescoped and shorted position, and wherein the second switching cam is configured in such a way that, starting from the telescoped position, the depressor is unlocked when the depressor is actuated in the pressing direction and can be extended out of a rear end of the housing into the first position.

2. A writing implement according to claim 1, further comprising a compression spring arranged to extend the depressor from the rear of the housing.

3. A writing implement according to claim 2, wherein said spring is arranged at least partly in the interior of the depressor.

4. A writing implement according to claim 1, wherein the control unit comprises a switching sleeve connected with the housing and an axially displaceable cam element that also is rotatable about a longitudinal axis.

5. A writing implement according to claim 4, wherein the switching sleeve inside the housing is secured in an axial direction and against rotation about a longitudinal axis.

6. A writing implement according to claim 4, wherein the switching sleeve has a coupling element that engages a first switching cam of the cam element.

7. A writing implement according to claim 6, wherein said coupling element comprises a radially inwardly pointing pin.

8. A writing implement according to claim 4, wherein the cam element has a front cavity for at least partly receiving the writing cartridge and a rear cavity for at least partly receiving the spring.

9. A writing implement according to claim 4, wherein the cam element comprises a partition against which the writing cartridge is supported on the one side and the spring on the other side.

10. A writing implement according to claim 4, wherein the cam element comprises both the first switching cam and the second switching cam.

11. A writing implement according to claim 1, wherein the first switching cam defines and locks the first position and the second position.

12. A writing implement according to claim 11, wherein the first switching cam is a heart-shaped cam.

13. A writing implement according to claim 1, wherein the second switching cam is a T-cam.

14. A writing implement according to claim 1, wherein the second switching cam comprises a cam element extending in a substantially circumferential direction.

* * * * *